United States Patent [19]

Amaya et al.

[11] 3,971,233

[45] July 27, 1976

[54] CIRCULAR KNITTING MACHINE WITH PATTERN PRODUCING DEVICES

[75] Inventors: Yukio Amaya, Ohbu; Kazufusa Sakakura, Kariya, both of Japan

[73] Assignee: Kabushiki Kaisha Toyoda Jidoshokki Seisausho, Kariya, Japan

[22] Filed: Nov. 14, 1974

[21] Appl. No.: 523,878

[30] Foreign Application Priority Data

Nov. 22, 1973 Japan ..... 48-134686

[52] U.S. Cl. ..... 66/50 R

[51] Int. Cl.[2] ..... D04B 9/00

[58] Field of Search ..... 66/50 R, 50 B, 25, 75 R, 66/50 A

[56] References Cited

UNITED STATES PATENTS

| | | | |
|---|---|---|---|
| 2,025,466 | 12/1935 | Lombardi | 66/50 A X |
| 3,283,541 | 11/1966 | De Cerjat | 66/50 R |
| 3,470,713 | 10/1969 | Carrotte | 66/25 |
| 3,500,662 | 3/1970 | Ribler | 66/50 R |
| 3,512,377 | 5/1970 | Widdowson et al. | 66/50 R |
| 3,851,500 | 12/1974 | Wolfshagen | 66/50 R |
| 3,863,465 | 2/1975 | De Cerjat et al. | 66/50 R |

FOREIGN PATENTS OR APPLICATIONS

| | | | |
|---|---|---|---|
| 312,305 | 5/1929 | United Kingdom | 66/50 R |
| 351,046 | 6/1931 | United Kingdom | 66/50 R |

*Primary Examiner*—Mervin Stein
*Assistant Examiner*—Andrew M. Falik
*Attorney, Agent, or Firm*—Wenderoth, Lind and Ponack

[57] ABSTRACT

A circular knitting machine comprising a camming mechanism and a cylinder having a series of needle slots, in which a series of jacks are disposed in a manner pivotable relative to and slidable along the associated needle slots and a series of knitting needles are disposed on the upper ends of the associated jacks. Each of the jacks is provided on its opposite end portions with a lower and an upper butt, the former butt being movable in a cam track of the camming mechanism and the latter being adapted to move in front of jack holding devices. Each jack holding device is controlled by a pattern control mechanism so that it attracts the particular jacks, when they approach it, corresponding to the particular knitting needles which are not to perform the knitting operation, whereby the particular jacks are turned to bring the lower butts into their position where the influence of the raising function of the camming mechanism is not exerted on the particular jacks and hence the particular knitting needles.

3 Claims, 7 Drawing Figures

CIRCULAR KNITTING MACHINE WITH PATTERN PRODUCING DEVICES

BACKGROUND OF THE INVENTION

This invention relates to a circular knitting machine provided with pattern creating devices.

In general, a circular knitting machine comprises a cylinder rotatable in one direction and provided in its peripheral surface with a series of circumferentially spaced needle slots, a series of individually movable knitting needles reciprocated in the associated needle slots, a series of jacks arranged below the associated needles in end to end relationship for reciprocating with the associated needles in the needle slots, each of the jacks having a butt extending out of the associated needle slot, and a camming mechanism including a number of raising cams arranged to define a cam track through which each butt passes when the cylinder is rotating. The knitting can be effected whenever each butt of the jack comes in contact with the raising cams and is thereby moved along with the associated needle upwardly in the associated needle slot.

In such a prior art circular knitting machine, e.g., a circular knitting machine as disclosed in Japanese Pat. Publication No. 46–7232 (No. 7232/71), in order to produce patterns, each of the jacks is formed with a resilient hanging down extension having a bottom butt extending from the bottom of the extension and urged by the resilience of the resilient extension to a position in which it is engageable with the raising cams. A presser is provided for each jack and it is mounted for pivotal motion. The upper and lower end portions of each presser are adapted to be normally inclined inwardly and outwardly of the cylinder by the resilience of the hanging down extension. An electrical magnet is provided for each presser, which corresponds in position to the upper end of each of the pressers so that, when energized, it can selectively attract the upper end of the presser to hold the presser, against the resilience of the hanging down extension, in a condition such that the upper and lower end portions of each presser are inclined outwardly and inwardly of the cylinder. When the presser is in such a condition, the bottom butt of the particular jack extension is temporarily retracted from the aforesaid position in which it is engageable with the raising cams, whereby the associated latch needle is prevented from making the upward movement and effecting the knitting operation, thus producing patterned fabrics.

However, the above prior art circular knitting machine has to have the latch needle, the jack and the presser in each associated needle slot of a relatively narrow width so as to interact to perform the desired operations. This makes it very difficult to assemble these elements into the cylinder in manufacturing the circular knitting machine because of a much greater number of elements. In addition, the prior art circular knitting machine requires that the bottom butt of the jack be arranged to move in a cam track while the electrical magnet is arranged to correspond in position to the upper end portion of the presser, which is not an integral portion of the jack, so that an appropriate adjustment of the relative positions therebetween is very hard to accomplish unless the elements are precisely machined and assembled into the circular knitting machine with special attention. Thus, the prior art circular knitting machine is very hard to manufacture.

SUMMARY OF THE INVENTION

It is therefore an object of the present invention to provide a circular knitting machine which eliminates the disadvantages of the prior art circular knitting machine.

According to the present invention, the cylinder of the circular knitting machine has around the periphery thereof a number of longitudinal needle slots, in which a like number of jacks are disposed for pivotal and reciprocating movements relative to the associated needle slots and in end to end relationship with a number of associated needles placed on the ends of the associated jacks, each jack being provided with upper and lower butts, one of which traces a cam track defined by the camming mechanism to move the associated needle up and down to carry out the knitting and the other of which corresponds in position to a jack holding device comprising an electrical magnet which attracts, when energized, the other butt to turn the jack to thereby bring the one butt out of the influence of needle raising cams of the camming mechanism to produce patterns. Such an arrangement of the present invention without pressers as used in the conventional circular knitting machine has various advantages; e.g., that the number of elements can be greatly decreased and hence the resulting circular knitting machine becomes simple and can be assembled with ease.

BRIEF DESCRIPTION OF THE DRAWINGS

The invention will become more readily apparent from the following detailed description taken in conjunction with the accompanying drawings in which similar reference numerals denote corresponding part throughout the several views and in which.

DESCRIPTION OF THE EMBODIMENT

The invention will be described in conjunction with the illustrated embodiments and more particularly in connection with a circular plain knitting machine, wherein the cams are stationary and the needles rotate in a clockwise direction, although, as will be pointed out hereinafter, the invention is not limited to this specific type of machine. For example, the needles can move in a counterclockwise direction, or the cams can rotate and the needles can be stationary. Whether the needles roatate or the cams rotate is immaterial, since it is only necessary to have relative movement between the cams and needles. It will therefore be understood, whenever reference is made hereinafter to needles or cylinder moving, that this does not necessarily mean that the needles move, but only means that there is relative rotation between the cams and the needles.

Figure 1:
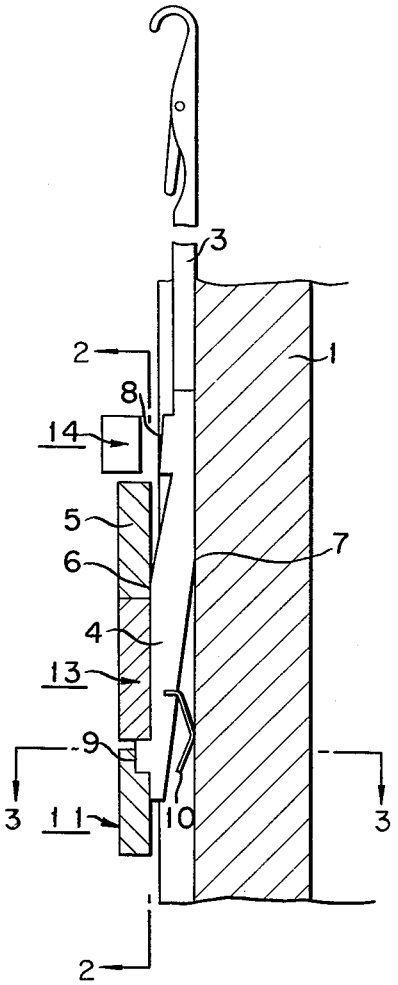
FIG. 1 is a fragmental enlarged view of the essential parts of the circular knitting machine according to the present invention, in section.
Figure 2:
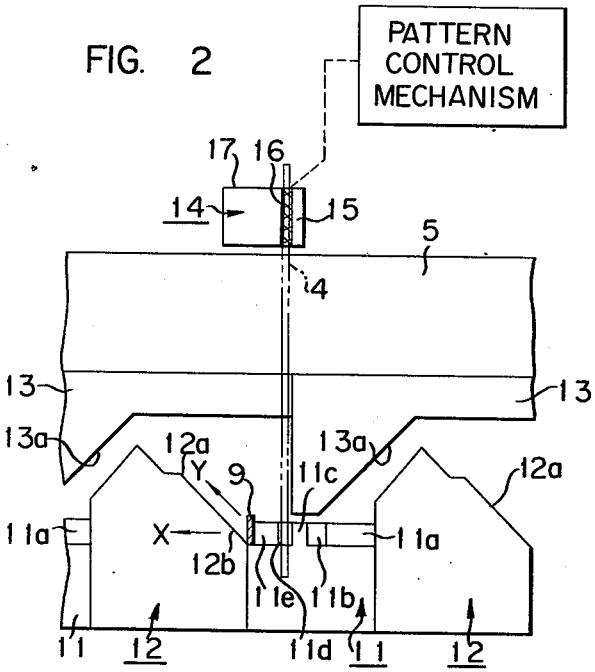
FIG. 2 is a fragmentary development as viewed on the line 2—2 of FIG. 1.
Figure 3:
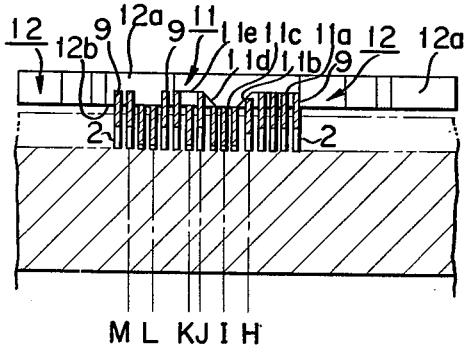
FIG. 3 is a developed section of a portion of the cylinder, through the cam track, taken on the line 3—3 of FIG. 1.

Referring now to FIGS. 1 to 3, there is shown a portion of a cylinder 1 of the circular plain knitting machine, the cylinder 1 being adapted to be driven in a direction X (see FIG. 2) by a not shown suitable driving means and having a number of needle slots 2 arranged longitudinally around, by way of example, the outer periphery of the cylinder 1. A like number of latch needles 3 are mounted for up and down sliding motion in the upper portions of the associated needle slots 2. As well known in the prior art circular knitting machine, the knitting can be performed by moving the latch needles 3 up and down along the associated needle slots 2 in particular timed relationship. For causing such a motion of the needle, a jack 4 is provided in the lower portion of the needle slot 2 for each needle 3 in operative contact therewith. Arranged around the cylinder 1 is a jack supporting member 5 which supports the jacks 4 in a manner allowing the sliding up and down and the swinging thereof. The upper end of each jack 4 abuts against the lower end of the associated knitting needle 3 to effect the upward movement of the needle 3, but the downward movement of each needle 3 is carried out by an associated stitch cam as hereinafter described.

For allowing the swingings of the jack 4, it is provided substantially at the opposite mid portions thereof with angled parts 6 and 7 to provide fulcra on which the jack 4 swings.

Each jack 4 is further provided with upper and lower butts 8 and 9 extending radially outwardly from the upper and lower end portions of the jack 4. Each of the jacks 4 is normally biased in a clockwise direction by an associated resilient means 10 so that its lower butt 9 extends out of the associated needle slot 2 as shown in FIG. 1. In this embodiment, the resilient means 10 consists of a plate spring disposed between the inner lower end portion of the jack 4 and the outer surface of the cylinder 1.

With respect to a camming mechanism for operating the needles 3, a set of cam sections comprising a plurality of jack turning cams 11, needle raising cams 12, and stitch cams 13 is provided. The jack turning cams 11 and needle raising cams 12 alternate around the cylinder 1. A suitable number of jack turning cams 11 (in this embodiment, 36 cams) are fixedly secured to a not shown cam carrier encircling the cylinder 1 so that they are positioned on the path of the lower butts 9 of the jacks 4. The cam 11 comprises cam surfaces 11*a*, 11*b*, 11*c*, 11*d* and 11*e* at different distances from the reference rotational axis of the cylinder 1. Therefore, upon contact of the outer edge of the butt 9 with the cam surfaces 11*a* to 11*d*, the jack 4 turns on the fulcra 6 and 7. A suitable number of the needle raising cams 12 (in this embodiment, 36 cams) are similarly fixed to the cam carrier so that they are positioned on the path of the lower butts 9 as shown in FIGS. 2 and 3. Each of the raising cams 12 has an upwardly inclined cam surface 12*a* which engages the lower edges of the butts 9 successively and raises the butts 9 successively. The stitch cams 13 (the number thereof is 36 in this embodiment) are mounted on the portion of the cam carrier above the cams 12 to oppose to the cams 12 and to define a cam track therebetween in which the butts 9 ride. Each stitch cam 13 has a downwardly inclined cam surface 13*a* which can engage the upper edge of the butt 9, which has been brought to the uppermost position or top dead point by the raising cam 12, to thereby move the associated butt 9 to the lowermost position or bottom dead point. As clearly shown in FIG. 2, the cam surface 13*a* extends from a position above the top of the raising cam surface 12*a* to a position adjacent to the left end of the cam surface 11*a* of the jack turning cam 11 so that, when the cylinder 1 is driven, the butt 9 of each jack 4 in the uppermost position follows the cam track portion defined by the cam surface 13*a* downwardly and the cam 12 and is guided onto the cam surface 11*b*. Thus, the successive jacks 4 are moved up and down by the actions of the raising and stitch cams, performing the knitting operation.

Figure 4:
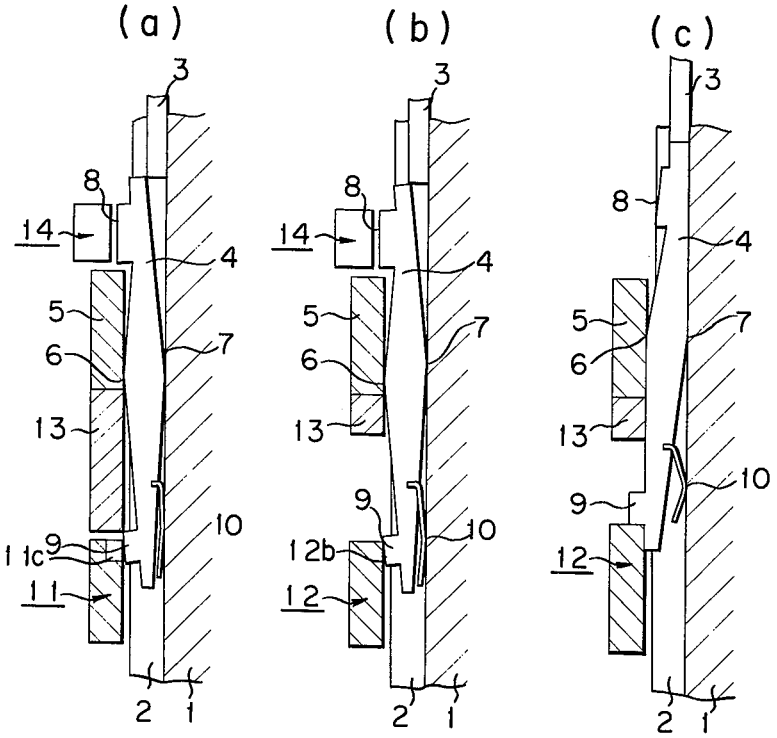
FIGS. 4(*a*) to 4(*c*) are diagrammatic sectional views illustrating the operation of the circular knitting machine of FIG. 1.

Arranged in a position over the cam surfaces 11*c*, 11*d* and 11*e* of each cam 11 and the lower end of the cam surface 12*a* butts of each cam 12 is a jack holding device 14 which is adapted to oppose to the upper butt 8 when the jack 4 passes therethrough. The jack holding device 14 comprises a permanent magnet 15, which exerts an attractive force stronger than the resilience of the plate spring 10, an electrical magnet 16, and a permanent magnet 17. The electrical magnet 16 is adapted to be brought into and out of its conductive state under control of a conventional pattern controlling mechanism so that it selectively attracts the upper butts 8 of particular jacks 4 when the particular butts 8 reach their position in front of the magnet 16. With respect to the permanent magnet 15, it is noted that when the butt 9 of the jack 4 reaches a position I (see FIG. 3) where it engages the cam surface 11*c* (see FIG. 4) after having been forced inwardly by cam surface 11*b*, the upper butt 8 is turned on the fulcra 6 and 7 toward the magnet 15 of the jack holding device 14 which therefore attracts the upper butt 8, holding the jack 4 in the turned condition. The jack 4 can continue to move leftwardly in FIGS. 2 and 3 while being attracted by the magnet 15. Upon further movement of the jack 4, it reaches a position shown by a chain line in FIG. 2; in this position the lower butt 9 comes in contact with the cam surface 11*d* while the upper butt 8 falls under the influence of the electrical magnet 16. Therefore, if the jack 4 is a particular one to be attracted by the magnet 16 and not to move the associated needle up and thus the pattern controlling mechanism causes the magnet 16 to be brought in the conductive state, such a particular jack 4 passes through the magnet 16 and comes in contact with the permanent magnet 17 while still being maintained in the turned condition shown in FIG. 4*a*. The butt 9 therefore contacts the inner side surface 12*b*, but not the surface 12*a*, of the needle raising cam 12 as shown at a position L in FIG. 3 and in FIG. 4*b* and continues to move in the direction X (see FIG. 2) without being moved up. In contrast, if the electrical magnet 16 is not energized as the jack 4 reaches the position shown by the chain line in FIG. 2, the lower butt 9 of the jack 4 will be restored to the normal condition shown in FIG. 1 by The successive engagement with the cam surfaces 11*d* and 11*e* and by the resilience of the plate spring 10. It is therefore understood that the upper butt 8 can move without being subject to the attraction by the permanent magnet 17. Thus, when the jack 4 approaches the needle raising cam 12, its lower butt 9 comes in contact with the cam surface 12*a* of the needle raising cam 12 as shown at a position M in FIG. 3 and in FIG. 4*c* and the lower butt 9 is caused to move up in a direction Y shown in FIG. 2.

In operation, it is assumed that the circular knitting machine thus far described with respect to the construction thereof is first in a condition that the particular knitting needle 3 and the associated jack 4 are in the lowermost position shown in FIG. 1 and its lower butt 9 is brought into contact with the cam surface 11*a* of the cam 11 by the resilient means 10. From FIG. 3, it is noted that the four butts 9 shown in the right hand portion of FIG. 3 are in such a condition.

Under such a condition, when the cylinder 1 rotates in the direction X, the aforesaid knitting needle 3 and the associated jack 4 also rotates in the same direction. The lower butt 9 of the jack 4 moves along the cam surface 11*a* and then the cam surface 11*b* to a position H shown into FIG. 3 and comes in the position I in which it engage the cam surface 11*c* after the jack 4 has been forced by cam surface 11*b* to the turned condition (FIG. 4*a*) against the resilience of the plate spring 10. At this time, the upper butt 8 of the jack 4 comes near the permanent magnet 15 of the jack holding device 14 and is attracted thereto, thus being held in the turned condition.

Upon further rotation of the cylinder 1, the jack 4 held in the turned condition comes in the position shown by the chain line in FIG. 2, wherein the lower butt 9 thereof is in contact with the inclined cam surface 11*d* of the cam 11 while the upper butt 8 is immediately in front of the electrical magnet 16. When the jack 4 is in this position, it tends to be resorted to its normal unturned condition shown in FIG. 1 due to the engagement of the lower butt 9 with the cam surface 11*d* and by the resilience of the resilient means 10. However, in case where the jack holding means 14 is so controlled by the pattern control mechanism as to bring the electrical magnet 16 into the conductive state, the jack 4 is held by the permanent magnet 15 in the turned condition shown in FIG. 4*a* and continues to move in the leftward direction in FIGS. 2 and 3 while remaining in the turned condition. Therefore, the upper butt 8 is then attracted to the permanent magnet 17 and the lower butt 9 is maintained out of engagement with the cam surface 11*e* of the cam 11 as shown at a position K in FIG. 3.

Since the attraction of the upper butt 8 to the permanent magnet 17 continues until the lower butt 9 of the jack 4 passes the jack turning cam 11 to a particular position on the needle raising cam 12, the lower butt 9 can move in the direction X while contacting the inner side surface 12*b* of the raising cam 12 as shown in FIG. 4*b* and at the position L in FIG. 3. The particular position of the butt 9 as mentioned above corresponds to a position of the upper butt 8 in which it is in front of the lefthand edge portion of the permanent magnet 17. Even when the upper butt 8 of the jack 4 passes leftwardly past the above-mentioned edge portion of the permanent magnet 17, the jack 4 is still held in the turned condition shown in FIG. 4*b*, since at this time the lower butt 9 is in contact with the inner side surface 12*b* of the raising cam 12. The jack 4 is restored to its original or unturned condition shown in FIG. 1 when the lower butt 9 is brought into engagement with the cam surface 11*a* of the next cam 11.

Thus, it is understood that when the electrical magnet 16 is energized, the jack 4 moves without being subject to the raising function of the cam 12 and therefore the knitting needle 3 on the upper end of the jack 4 is not caused to move upwardly, the knitting by such a needle being unperformed.

In the case where the electrical magnet 16 is not in the conductive state due to the control by the pattern control mechanism when the jack 4 approaches the position shown by the chain line in FIG. 2, the jack 4 which had been held by the permanent magnet 15 in the turned condition shown in FIG. 4*a* is restored to the condition shown in FIG. 1 by the resilience of the spring 10 and due to the successive engagement of the lower butt 9 with the cam surfaces 11*d* and 11*e* as shown at a position J in FIG. 3. Then, the upper butt 8 moves past the permanent magnet 17 while the lower butt 9 engages the cam surface 12*a* to the needle raising cam 12. At this time, the jack 4 is not attracted to the permanent magnet 17 since there is a space between the upper butt 8 and the permanent magnet 17 sufficient to prevent the contact therebetween against the resilience of the plate spring 10. The lower butt 8 can therefore move up in the direction Y shown in FIG. 2 while contacting the cam surfaces 12of the needle raising cam 12 as shown at a position M in FIG. 3 and in FIG. 4*c*.

Thus, it is understood that when the electrical magnet 16 is not energized, the butt 9 moves up along the cam surface 12*a* to its top dead point and hence down along the inner side surface 13*a* of the stitch cam 13 to the position H shown in FIG. 3, performing the knitting operation by moving the associated knitting needle 3 up and down accordingly.

It is also understood that a required pattern or patterns can be created in a knitted fabric by causing the successive knitting needles to perform or not to perform the knitting operation whenever the upper butts 8 of the associated jacks 4 pass across the jack holding device 14.

The electrical magnet 16 is adapted to be energized only during the time the jack passes thereacross. In this case, large sized electrical magnet, which exerts a very strong attractive force on the jack, is not necessary and a compact electrical magnet can be employed, resulting in a less electrical power consumption thereof.

Figure 5:
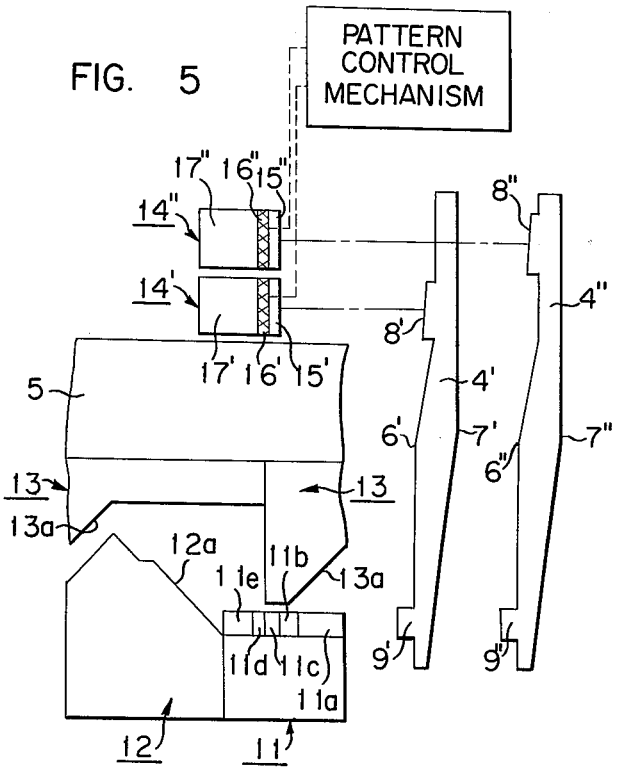
FIG. 5 is a view somewhat corresponding to that of FIG. 2, showing a different embodiment of the invention.

In FIG. 5, a different circular knitting machine is illustrated in a modified form, in which a pair of jack holding devices 14′ and 14″, the construction and the function thereof being the same as the jack holding device 14 thus far described, are provided for each jack turning cam 11 with one above another. Two types of various an 4′ and 4″, different from each other only in the positions of the upper butts 8′ and 8″ thereof, are alternatively arranged in the needle slots 2 of the cylinder 1 so that the upper butts 8′ and 8″ can pass in front of the holding devices 14′ and 14″, respectively. Thus, the jacks 4′ and 4″ are alternatively controlled by the holding devices 14′ and 14″. It is to be noted that three or more holding devices may be provided for each jack turning cam. Such an arrangement has an advantage that an appropriate pattern creating operation can be accomplished without the necessity of narrowing the width of the electrical magnet because the electrical magnet 16′ or 16″ once having attracted the upper butt 8′ or 8″ thereto does not act on the next adajcent upper butt 8″ or 8′.

Although the invention has been illustrated and described with reference to the specific embodiments thereof, it is to be understood that various changes in the details of constructions and the arrangement and combination of parts may be made with departing from the spirit and scope of the invention. For example, the resilient means 10 may be an integral part of the jack 4. All the resilient means 10 may be formed in one piece which is arranged in the cylinder with a plurality of resilient arms extending in the associated needle slots towards the associated jacks. Furthermore, it may be possible to turn the arrangement of the holding devices and camming mechanism upside down. In this case, the upper butt 8 is controlled by the jack holding device and the lower butt 9 is guided in the cam track defined by the cams 11, 12 and 13.

What we claim is:

1. A circular knitting machine including a cylinder provided with needle slots; a series of independently operable knitting needles disposed in said needle slots; a series of needle operating jacks having fulcra at the mid-portions thereof and being disposed, one for each needle, in said needle slots in abutting end to end relation with lower ends of said needles and disposed in said slots for pivotal movement about said fulcra and for reciprocating movement along said needle slots, each of said jacks having a one-piece integral structure, and being provided at the opposite end portions with outwardly extending lower and upper butts; a camming mechanism disposed along a circumferential surface of said cylinder, said camming mechanism comprising needle raising cams engagable with one of the butts for causing one of the butts on each of said jacks to move upwardly along said needle slot when it engages said needle raising cams, and jack turning cams engagable with each of said one of the butts to turn said jack from a position in which it can be raised by said needle raising cams to a position in which it cannot be raised by said raising cams; a series of jack holding means disposed so as to correspond in position to the other of the butts of each of said jacks for magnetically holding particular jacks, which are not to bring about a knitting operation, among said jacks having been turned by said jack turning cams to said position in which said jacks cannot be raised by said needle raising cams, said jack holding means being circumferentially disposed outwardly of the series of needle operating jacks for acting on the other of said butts, each of jack holding means comprising two permanent magnets and one electrical magnet interposed between said permanent magnets, said three magnets being transversely aligned in contact with each other; and resilient spring means for normally urging said one of the butts on each of said jacks toward said needle raising cams and said jack turning cams, said resilient spring means being disposed inwardly of the series of needle operating jacks.

2. A circular knitting machine according to claim 1 further comprising means for energizing said electrical magnet of each of said jack holding means when said particular jacks approach to attract said particular jacks against the resilience of said resilient means, thereby holding said particular jacks in said position in which said particular jacks cannot be raised by said needle raising cams.

3. A circular knitting machine including a cylinder provided with needle slots; a series of independently operable knitting needles disposed in said needle slots; a series of needle operating means having fulcra at the mid-portions thereof and being disposed, one for each needle, in said needle slots in end to end relation with lower ends of said needles and for pivotal movement about said fulcra and for reciprocating movement along said needle slots, said needle operating means consisting of a plurality of groups of jacks, each group being of a different kind of jacks and the individual jacks of one group being alternatively disposed in said needle slots with the jacks of the other groups, said jacks being of a one piece intergral structure provided at the opposite end portions with lower and upper butts, the different jacks having said upper butts in different positions from each other; a camming mechanism disposed along a circumferential surface of said cylinder, said camming mechanism comprising needle raising cams which cause the lower butt of each of said jacks to move upwardly along said needle slot when it engages said needle raising cams and jack turning cams which force the lower butt of each of said jacks, when it engages said turning cams, to turn said associated jack from a position in which it can be raised by said needle raising cams to a position in which it cannot be raised by said raising cams; a plurality of series of jack holding means, one for each group of jacks, disposed so as to correspond in position to the upper butts of said respective different kinds of jacks for magnetically holding particular jacks, which are not to perform a knitting operation, among said jacks having been turned by said jack turning cams to said position in which said jacks cannot be raised by said needle raising cams, said jack holding means being circumferentially disposed outwardly of the groups of needle operating jacks, each jack holding means comprising two permanent magnets and one electrical magnet interposed between said permanent magnets, said three magnets being transversely aligned in contact with each other; and resilient means for normally urging said lower butt of each of said jacks toward said needle raising cams and said jack turning cams, said resilient spring means being disposed inwardly of the series of needle operating jacks.

* * * * *